US011527200B2

(12) United States Patent
Kobayashi

(10) Patent No.: US 11,527,200 B2
(45) Date of Patent: Dec. 13, 2022

(54) DISPLAY DEVICE AND DRIVING METHOD THEREOF

(71) Applicant: SHARP KABUSHIKI KAISHA, Sakai (JP)

(72) Inventor: Fumiyuki Kobayashi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/438,627

(22) PCT Filed: Mar. 28, 2019

(86) PCT No.: PCT/JP2019/013543
§ 371 (c)(1),
(2) Date: Sep. 13, 2021

(87) PCT Pub. No.: WO2020/194647
PCT Pub. Date: Oct. 1, 2020

(65) Prior Publication Data

US 2022/0223106 A1 Jul. 14, 2022

(51) Int. Cl.
*G09G 3/3233* (2016.01)

(52) U.S. Cl.
CPC ... *G09G 3/3233* (2013.01); *G09G 2300/0819* (2013.01); *G09G 2300/0861* (2013.01);
(Continued)

(58) Field of Classification Search
None
See application file for complete search history.

(56) References Cited

U.S. PATENT DOCUMENTS 10,923,032 B2 * 2/2021 Qing ..... G09G 3/3275
2009/0009441 A1 * 1/2009 Yamamoto ..... G09G 3/3233 345/80

(Continued)

FOREIGN PATENT DOCUMENTS

JP 2008-292786 A 12/2008
JP 2011-175103 A 9/2011

(Continued)

OTHER PUBLICATIONS

WO2018225203 English translation printed from Search, pp. 1-19 (Year: 2018).*

*Primary Examiner* — Dorothy Harris
(74) *Attorney, Agent, or Firm* — ScienBiziP, P.C.

(57) ABSTRACT

A pixel circuit of a display device Includes: an electro-optical element; a drive transistor; a write control transistor; a threshold compensation transistor; two light emission control transistors; a first initialization transistor having a first conduction terminal connected to a gate terminal of the drive transistor, a second conduction terminal to which an initialization voltage is applied, and a gate terminal connected to a first initialization control line; and a capacitor provided between a first conductive member and the gate terminal of the drive transistor. In a non-light emission period, time during which a voltage of the first initialization control line is at an on-level is longer than a period during which a voltage of a scanning line is at the on-level. As a result, a display device capable of sufficiently initializing the gate terminal of the drive transistor is provided.

17 Claims, 6 Drawing Sheets

(52) U.S. Cl.
CPC . *G09G 2310/0251* (2013.01); *G09G 2310/08* (2013.01); *G09G 2320/045* (2013.01)

(56) References Cited

U.S. PATENT DOCUMENTS

| | | | | |
|---|---|---|---|---|
| 2011/0205205 | A1 | 8/2011 | Yamamoto et al. | |
| 2013/0002632 | A1* | 1/2013 | Choi | G09G 3/325 345/76 |
| 2015/0371606 | A1* | 12/2015 | Lee | G09G 3/3233 345/82 |
| 2017/0140706 | A1* | 5/2017 | Song | G09G 3/3233 |
| 2017/0365218 | A1* | 12/2017 | Jeong | G09G 3/3258 |

FOREIGN PATENT DOCUMENTS

| | | | |
|---|---|---|---|
| JP | 2017-223955 | A | 12/2017 |
| WO | 2018/225203 | A1 | 12/2018 |
| WO | WO-2018225203 | A1 * | 12/2018 |

* cited by examiner

DISPLAY DEVICE AND DRIVING METHOD THEREOF

TECHNICAL FIELD

The disclosure relates to a display device, and particularly to a display device provided with a pixel circuit including an electro-optical element.

BACKGROUND ART

In recent years, an organic electroluminescent (hereinafter referred to as SL) display device provided with a pixel circuit including an organic EL element has been put to practical use. The pixel circuit of the organic EL display device includes, in addition to the organic EL element, a drive transistor, a write control transistor, and the like. Thin-film transistors (hereinafter referred to as TFT) are used for these transistors. The organic EL element is a kind of electro-optical element and emits light with luminance corresponding to the amount of a flowing current. The drive transistor is provided in series with the organic EL element and controls the amount of current flowing through the organic EL element.

Variations or shifts occur in the characteristics of the organic EL element and the drive transistor. Thus, for performing a high-quality display in the organic EL display device. It is necessary to compensate for variations and shifts in the characteristics of these elements. As for the organic EL display device, a method of compensating the characteristics of the element inside the pixel circuit and a method of compensating the characteristics outside the pixel circuit are known. In the organic EL display device, the processing of initializing a gate terminal of a drive transistor may be performed before a voltage (hereinafter referred to as a data voltage) corresponding to a video signal is written to a pixel circuit.

Many pixel circuits have been devised for organic EL display devices. For example, a pixel circuit 90 illustrated in FIG. 6 including seven TFTs: M91 to M97, an organic EL element L91, and a capacitor C91 is known. In the pixel circuit 90, the gate terminals of the TFTs: M92, M93, M97 are connected to a scanning line Gi. The gate terminal of the TFT: M91 is connected to a scanning line Gi−1 selected one horizontal period before the scanning line Gi. The TFT: M94 functions as a drive transistor.

FIG. 9 is a timing chart of the display device including the pixel circuit 90. The TFT: M91 is turned on in an initialization period during which the voltage of the scanning line Gi−1 is at a low level. The gate terminal of the TFT: M94 (drive transistor) is initialized using an initialization voltage Vini in the initialization period. The TFTs: M92, M93, M97 are turned on in a write period during which the voltage of the scanning line Gi is at the low level. The gate voltage of the TFT: M94 changes to a level corresponding to the data voltage and the threshold voltage of the TFT: M94 in the write period.

In relation to the disclosure, Patent Document 1 describes a display device that performs an operation of detecting a gate-source voltage of a drive transistor by applying a constant current to the drive transistor over a plurality of horizontal periods. Patent Document 2 also describes a display device that performs a threshold correction operation by dividing the threshold correction operation into a plurality of times.

CITATION LIST

Patent Documents

[Patent Document 1] Japanese Laid-Open Patent Publication No. 2006-292766

[Patent Document 2] Japanese Laid-Open Patent Publication No. 2011-175103

SUMMARY

Technical Problem

For performing high-luminance display in a display device including the pixel circuit 90, it is necessary to increase the channel width of the TFT: M94 so as to increase the amount of current flowing through the TFT: M94. In order to stably maintain the gate voltage of the TFT: M94 when the amount of current flowing through the TFT: M94 increases, it is necessary to increase the capacitance of the capacitor C91 connected to the gate terminal of the TFT: M94.

The gate terminal of the TFT: M94 is initialized by turning on the TFT: M91 in the initialization period. However, when the capacitance of the capacitor C91 is increased to perform high-luminance display, it becomes difficult to initialize the gate terminal of the TFT: M94 within the initialization period. More specifically, even when the voltage of the scanning line Gi−1 becomes the low level in the initialization period, and the TFT: M91 is turned on, the gate voltage of the TFT: M94 may not reach the initialization voltage Vini the initialization period. When the gate terminal of the TFT: M94 cannot be sufficiently initialized, the image quality of a display image deteriorates.

Therefore, it is an object to provide a display device that sufficiently initializes a gate terminal of a drive transistor and performs high luminance and high-quality display.

MEANS FOR SOLVING THE PROBLEMS

The above-described problem can be solved by a display device, for example, provided with: a display portion including a plurality of scanning lines, a plurality of data lines, a plurality of light emission control lines, a plurality of initialization control lines, and a plurality of pixel circuits arranged two-dimensionally; a scanning line drive circuit configured to drive each of the scanning lines; a data line drive circuit configured to drive each of the data lines; a light emission control line drive circuit configured to drive each of the light emission control lines; and an initialization control line drive circuit configured to drive each of the initialization control lines, wherein the plurality or initialization control lines includes a first initialization control line that extends in parallel with any one of the plurality of scanning lines, corresponding to the scanning line, the pixel circuit includes an electro-optical element provided on a path connecting first and second conductive members that each supply a power supply voltage, the electro-optical element being configured to emit light with luminance corresponding to a current flowing through the path; a drive transistor provided on the path in series with the electro-optical element and configured to control an amount of current flowing through the path; a write control transistor having a first conduction terminal connected to the data line, a second conduction terminal connected to a first conduction terminal of the drive transistor, and a gate terminal connected to the scanning line; a threshold compensation transistor having a first conduction terminal connected to a second conduction terminal of the drive transistor, a second conduction terminal connected to a gate terminal of the drive transistor, and a gate terminal connected to the scanning line; a first light emission control transistor having a first conduction terminal connected to the first conductive member, a second conduction terminal connected to the first conduction terminal of the drive transistor, and a gate terminal connected to the light emission control line; a second light emission control transistor having a first conduction terminal connected to the second conduction terminal of the drive transistor, a second conduction terminal connected to a first terminal of the electro-optical element, and a gate terminal connected to the light emission control line; a first initialization transistor having a first conduction terminal connected to the gate terminal of the drive transistor, a second conduction terminal to which an initialization voltage is applied, and a gate terminal connected to the first initialization control line, and a capacitor provided between the first conductive member and the gate terminal of the drive transistor, a second terminal of the electro-optical element is connected to the second conductive member, and in a non-light emission period when a voltage of the light emission control line is at an off-level, time during which a voltage of the first initialization control line is at an on-level is longer than a period during which a voltage of the scanning line is at the on-level.

The above-described problem can also be solved by a method for driving a display device provided with a display portion including a plurality of scanning lines, a plurality of data lines, a plurality of light emission control lines, a plurality of initialization control lines, and a plurality of pixel circuits arranged two-dimensionally, wherein, in a case where the plurality of initialization control lines includes a first initialization control line extending in parallel with any one of the plurality of scanning lines, corresponding to the scanning line, the pixel circuit includes the above-described constituent elements, and a second terminal of the electro-optical element is connected to the second conductive member, the method includes the steps of: controlling a voltage of the light emission control line to an off-level to control the electro-optical element to a non-light emitting state; controlling a voltage of the first initialization control line to an on-level to initialize the gate terminal of the drive transistor; and driving the scanning line and the data line to write a data voltage corresponding to a video signal to the gate terminal of the drive transistor, and in a non-light emission period when the voltage of the light emission control line is at the off-level, time during which the voltage of the first initialization control line is at the on-level is longer than a period during which a voltage of the scanning line is at the on-level.

Effects of the Disclosure

According to the display device and the driving method thereof, by making the time during which the voltage of the first initialization control line is at the on-level longer than the period during which the voltage of the scanning line is at the on-level, the gate terminal of the drive transistor is initialized for a longer time than the writing of the data voltage. Hence, it is possible to sufficiently initialize the gate terminal of the drive transistor and perform high-quality display. In particular, even when the capacitance of the capacitor connected to the gate terminal of the drive transistor is increased in order to perform high-luminance display, it is possible to sufficiently initialize the gate terminal of the drive transistor and perform high-luminance and high-quality display.

DESCRIPTION OF EMBODIMENTS

Figure 1:
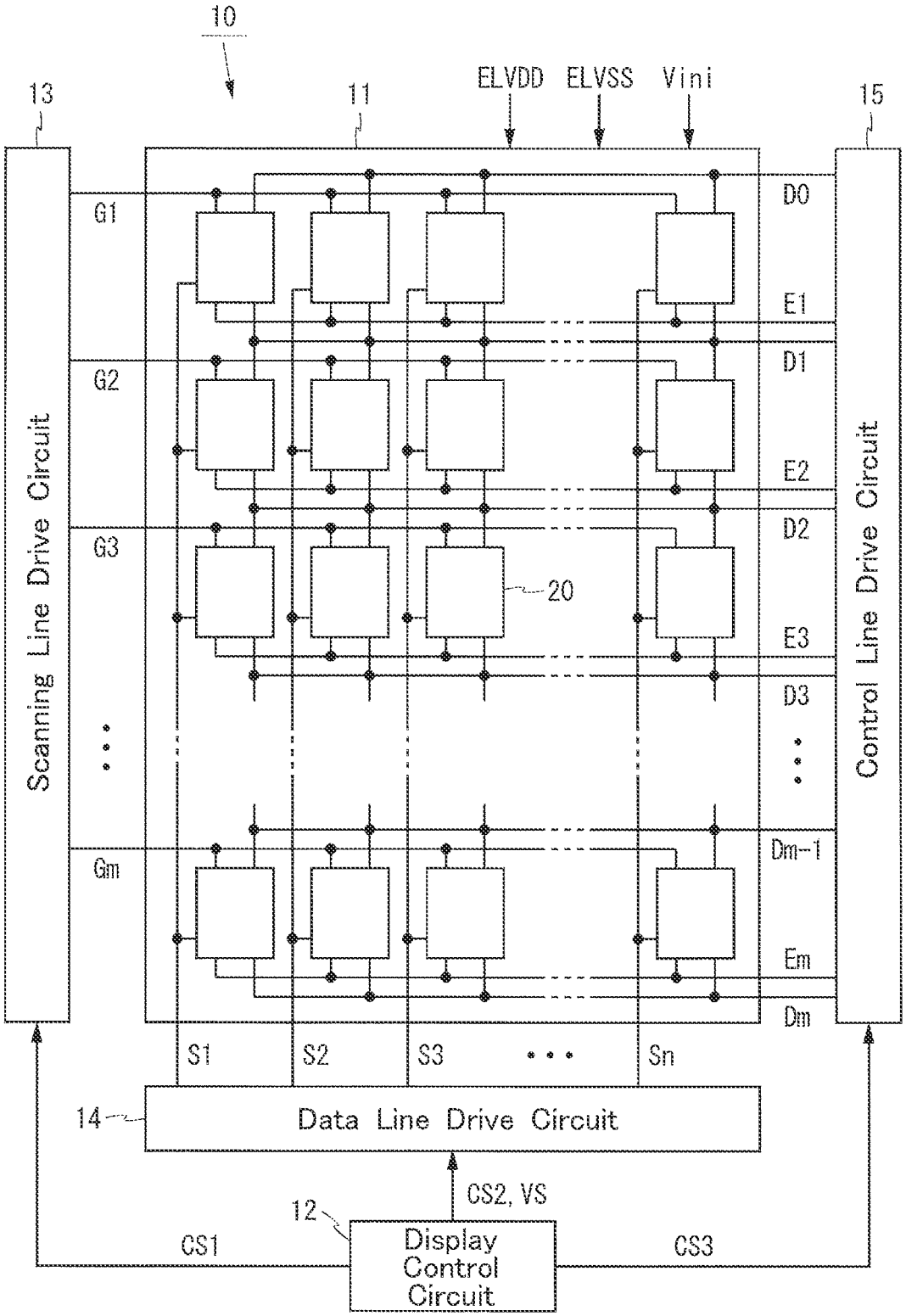
FIG. 1 is a block diagram illustrating a configuration of a display device according to a first embodiment.

Hereinafter/a display device according to each embodiment will be described with reference to the drawings. The display device according to each embodiment is an organic EL display device provided with a pixel circuit including an organic EL element. The organic EL element is a kind of electro-optical element and called an organic light-emitting diode or OLED. In the following description, a horizontal direction of the drawing is referred to as a row direction, and a vertical direction of the drawing is referred to as a column direction. In addition, m and n are integers of 2 or more, i is an integer of 1 or more and m or less, and j is an integer of 1 or more and n or less. The level of a voltage at which a transistor is turned on when the voltage is applied to a gate terminal is referred to as an on-level, and the level of the voltage at which the transistor is turned off when the voltage is applied to the gate terminal is referred to as an off-level. For example, for a P-channel transistor, a high level is the off-level, and a low level is the on-level.

First Embodiment

FIG. 1 is a block diagram illustrating a configuration of a display device according to a first embodiment. The display device 10 illustrated in FIG. 1 is provided with a display portion 11, a display control circuit 12, a scanning line drive circuit 13, a data line drive circuit 14, and a control line drive circuit 15.

The display portion 11 includes m scanning lines G1 to Gm, n data lines S1 to Sn, m light emission control lines E1 to Em, (m+1) initialization control lines D0 to Dm, and (m+n) pixel circuits 20. The scanning lines G1 to Gm extend in the row direction and are arranged in parallel to each other. The data lines S1 to Sn extend in the column direction and are arranged in parallel to each other so as to be orthogonal to the scanning lines G1 to Gm. The light emission control lines E1 to Em and the initialization control lines D0 to Dm extend in the row direction and are arranged in parallel with the scanning lines G1 to Gm. The scanning lines G1 to Gm and the data lines S1 to Sn intersect at (m×n) locations. The (m×n) pixel circuits 20 are two-dimensionally arranged corresponding to the intersections of the scanning lines G1 to Gm and the data lines S1 to Sn. The pixel circuit 20 on an ith row and a jth column is connected to the scanning line G1, the data line Sj, the light emission control line Ei, and the initialization control lines Di−1, Di. Three types of voltages (a high-level power supply voltage ELVDD, a low-level power supply voltage ELVSS, and an initialization voltage Vini) are fixedly supplied to each pixel circuit 20 by using a conductive member (wiring line or electrode) not illustrated.

The display control circuit 12 outputs a control signal CS1 to the scanning line drive circuit 13, outputs a control signal CS2 and a video signal VS to the data line drive circuit 14, and outputs a control signal CS3 to the control line drive circuit 15. The scanning line drive circuit 13 drives the scanning lines G1 to Gm based on the control signal CS1. The data line drive circuit 14 drives the data lines S1 to Sn based on the control signal CS2 and the video signal VS. The control line drive circuit 15 drives the light emission control lines E1 to Era and the initialization control lines D0 to Dm based on the control signal CS3.

More specifically, the scanning line drive circuit 13 sequentially selects one scanning line from among the scanning lines G1 to Gm based on the control signal CS1 and applies an on-level (low-level) voltage to the selected scanning line. Thereby, the n pixel circuits 20 connected to the selected scanning line are selected collectively. The data line drive circuit 14 applies n data voltages corresponding to the video signal VS to the data lines S1 to Sn based on the control signal CS2. Thereby, the n data voltages are written to the respective selected n pixel circuits 20.

The control line drive circuit 15 applies an on-level voltage to the light emission control line Ei in the light emission period of the pixel circuits 20 in the ith row and applies an off-level (high-level) voltage to the light emission control line Ei in a non-light emission period of the pixel circuits 20 in the ith row. While the voltage of the light emission control line Ei is at the on-level, the organic EL elements in the pixel circuits 20 in the ith row emit light with luminances corresponding to the respective data voltages written to the pixel circuits 20. The control line drive circuit 15 selectively applies an on-level voltage and an off-level voltage to the initialization control line Di at timing to be described later.

In the display device 10, m horizontal periods are set to select m scanning lines within one frame period during which one image is displayed. The initialization control lines D0 to Dm include the initialization control line Di−1 as a first initialization control line that extends in parallel with the scanning line Gi, corresponding to the scanning line Gi. Further, the initialization control lines D0 to Dm extend in parallel to the scanning line Gi, corresponding to the scanning line Gi, and include the initialization control line Di as a second initialization control line selected one horizontal period later than the first initialization control line. The length of the time from the start of the selection of the scanning line Gi−1 to the start of the selection of the scanning line Gi is equal to the length of one horizontal period. The length of the time from the end of the selection of the scanning line Gi−1 to the end of the selection of the scanning line Gi is also equal to the length of one horizontal period.

In FIG. 1, the scanning line drive circuit 13 is disposed on the left side of the display portion 11, and the control line drive circuit 15 is disposed on the right side of the display portion 11. Alternatively, the scanning line drive circuit 13 and the control line drive circuit 15 may be disposed on the same side of the display portion 11. The control line drive circuit 15 is a circuit combining a light emission control line drive circuit that drives the light emission control lines E1 to Em and an initialization control line drive circuit that drives the initialization control lines D0 to Dm. The control line drive circuit 15 may be divided into a light emission control line drive circuit and an initialization control line drive circuit, and two circuits may be disposed on opposite sides of the display portion 11.

Figure 2:
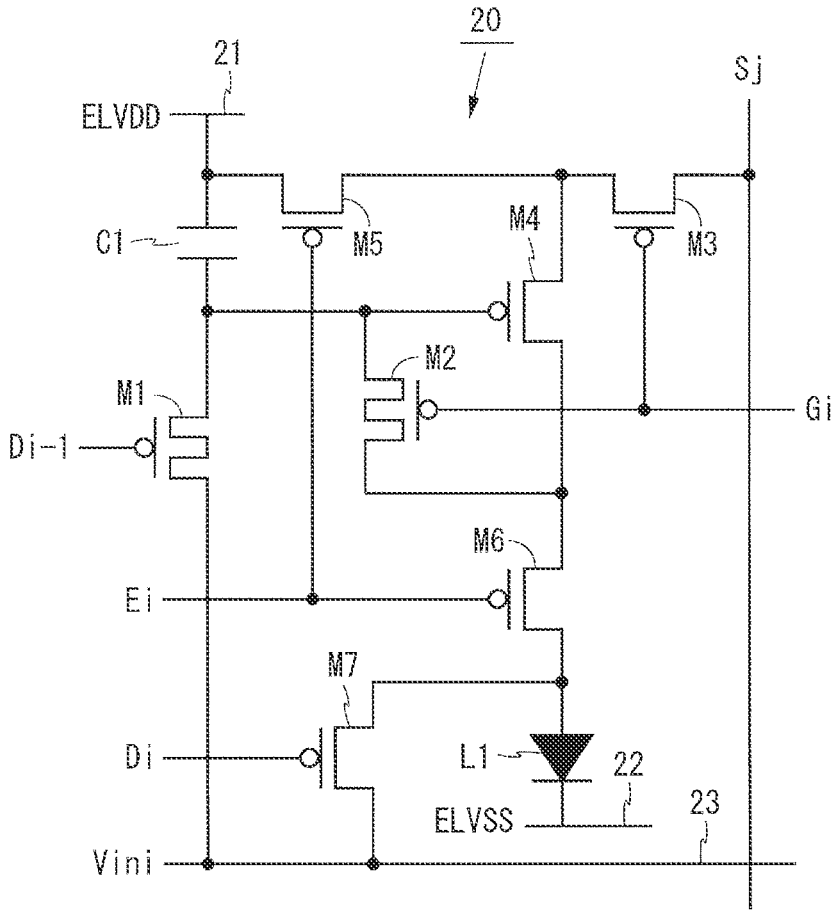
FIG. 2 is a circuit diagram of a pixel circuit of the display device illustrated in FIG. 1.

FIG. 2 is a circuit diagram of the pixel circuit 20. In FIG. 2, the pixel circuit 20 in the ith row and the jth column is described. The pixel circuit 20 illustrated in FIG. 2 includes seven TFTs: M1 to M7, an organic EL element L1, and a capacitor C1. The TFTs: M1 to M7 are P-channel transistors, and the TFTs: M1, M2 are double gate transistors each having two gate terminals. The TFTs: M1, M2 may each be a single gate transistor having one gate terminal. Hereinafter, power supply wiring line having the high-level power supply voltage ELVDD is referred to as first power supply wiring line 21, power supply wiring line having the low-level power supply voltage ELVSS is referred to as second power supply wiring line 22, and wiring line having the initialization voltage Vini is referred to as initialization voltage wiring line 23.

Note that the TFT included in the pixel circuit 20 may be an amorphous silicon transistor having a channel layer formed of amorphous silicon, a low-temperature polysilicon transistor having a channel layer formed of low-temperature polysilicon, or an oxide semiconductor transistor having a channel layer formed of an oxide semiconductor. For example, indium-gallium-zinc oxide (referred to as IGZO) may be used for the oxide semiconductor. The TFT included in the pixel circuit 20 may be a top gate type or a bottom gate type. Instead of the pixel circuit 20 including the P-channel transistor, a pixel circuit including an N-channel transistor may be used. When a pixel circuit is configured using an N-channel transistor, polarities of a signal supplied to the pixel circuit and a power supply voltage may be inverted.

The source terminal of the TFT: M5 and one electrode (the upper electrode in FIG. 2) of the capacitor C1 are connected to the first power supply wiring line 21. The first conduction terminal (the right terminal in FIG. 2) of the TFT: M3 is connected to the data line Sj. The drain terminal of the TFT: M5 and the second conduction terminal of the TFT: M3 are connected to the source terminal of the TFT: M4. The drain terminal of the TFT: M4 is connected to the first conduction terminal (the lower terminal in FIG. 2) of the TFT: M2 and the source terminal of the TFT: M6. The drain terminal of the TFT: M6 is connected to the anode terminal of the organic EL element L1 and the source terminal of the TFT: M7. The cathode terminal of the organic EL element L1 is connected to the second power supply wiring line 22. The second conduction terminal of the TFT: M2 is connected to the gate terminal of the TFT: M4, the other electrode of the capacitor C1, and the first conduction terminal (the upper terminal in FIG. 2) of the TFT: M1. The second conduction terminal of the TFT: M1 and the drain terminal of the TFT: M7 are connected to the initialization voltage wiring line 23. The initialization voltage Vini is applied to the second conduction terminal of the TFT: M1 and the drain terminal of the TFT: M7. The gate terminals of the TFTs: M2, M3 are connected to the scanning line Gi, the gate terminals of the TFTs: M5, M6 are connected to the light emission control line Ei, and the gate terminal of the TFT: M7 is connected to the initialization control line Di. The gate terminal of the TFT: M1 is connected to the initialization control line Di−1 selected one horizontal period before the initialization control line Di.

In the pixel circuit 20, the organic EL element L1 is provided on a path connecting the first and second conductive members (the first power supply wiring line 21 and the second power supply wiring line 22) that each supply the power supply voltage, and functions as an electro-optical element that emits light with luminance corresponding to the current flowing through the path. The TFT: M4 is provided in series with the electro-optical element on the path and functions as a drive transistor that controls the amount of current flowing through the path. The TFT: M3 functions as a write control transistor having a first conduction terminal connected to the data line Sj, a second conduction terminal connected to the first conduction terminal of the drive transistor, and a gate terminal connected to the scanning line Gi. The TFT: M2 functions as a threshold compensation transistor having a first conduction terminal connected to the second conduction terminal of the drive transistor, a second conduction terminal connected to the gate terminal of the drive transistor, and a gate terminal connected to the scanning line Gi. The TFT: M5 functions as a first light emission control transistor having a first conduction terminal connected to the first conductive member, a second conduction terminal connected to the first conduction terminal of the drive transistor, and a gate terminal connected to the light emission control line Ei. The TFT: M6 functions as a second light emission control transistor having a first conduction terminal connected to the second conduction terminal of the drive transistor, a second conduction terminal connected to the first terminal (anode terminal) of the electro-optical element, and a gate terminal connected to the light emission control line Ei.

The TFT: M1 functions as a first initialization transistor having a first conduction terminal connected to the gate terminal of the drive transistor, a second conduction terminal to which the initialization voltage Vini is applied, and a gate terminal connected to the first initialization control line (initialization control line Di−1). The TFT: M7 functions as a second initialization transistor having a first conduction terminal connected to an anode terminal of the electro-optical element, a second conduction terminal to which the initialization voltage Vini is applied, and a gate terminal connected to the second initialization control line (initialization control line Di), The capacitor C1 is provided between the first conductive member and the gate terminal of the drive transistor. The second terminal (cathode terminal) of the electro-optical element is connected to the second conductive member.

Figure 3:
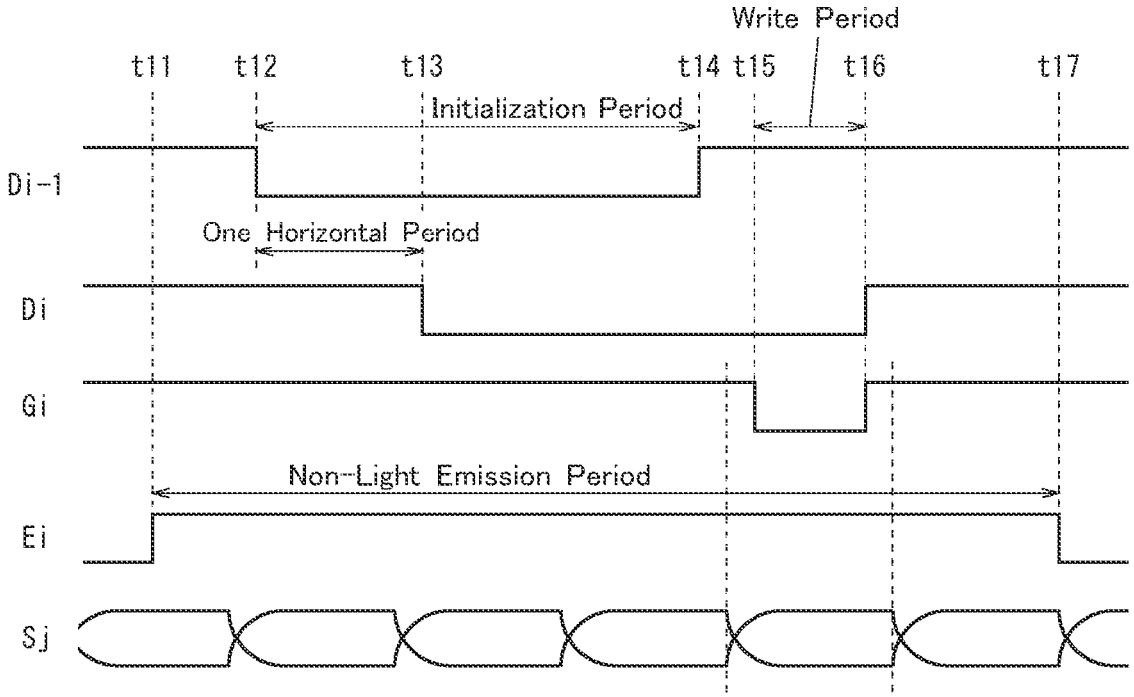
FIG. 3 is a timing chart of the display device illustrated in FIG. 1.

FIG. 3 is a timing chart of display device 10. FIG. 3 illustrates a change in voltage when a data voltage is written to the pixel circuit 20 in the ith row and the jth column. In FIG. 3, a period from time t11 to time t17 is a non-light emission period of the pixel circuit 20 in the ith row. A period from time t12 to time t14 is an initialization period of the pixel circuit 20 in the ith row. A period from time t15 to time t16 is a write period of the pixel circuit 20 in the ith row. In the write period, the writing of the data voltage and the threshold compensation of the drive transistor are performed. Since the initialization control line Di is selected one horizontal period later than the initialization control line Di−1, the length of the time from time t12 to time t13 is equal to the length of one horizontal period.

Before time t11, the voltages of the initialization control lines Di−1, Di and the scanning line Gi are at a high level, and the voltage of the light emission control line Ei is at a low level. Therefore, the TFTs: M1 to M3, M7 are in an off state, and the TFTs: M5, M6 are in an on state. At this time, when the gate-source voltage of the TFT: M4 is equal to or lower than the threshold voltage, the current passing through the TFTs: M5, M4, M6 and the organic EL element LI flows from the first power supply wiring line 21 toward the second power supply wiring line 22, and the organic EL element LI emits light with luminance corresponding to the amount of the flowing current.

At time t11, the voltage of the light emission control line Ei changes to the high level. Accordingly, the TFTs: M5, M6 are turned off. Therefore, after time t11, the current passing through the organic EL element L1 does not flow, and the organic EL element L1 enters the non-light emitting state.

Next at time t12, the voltage of the initialization control line Di−1 changes to the low level. Accordingly, the TFT: M1 is turned on. Therefore, the current passing through the TFT: M1 flows from the gate terminal of the TFT: M4 toward the initialization voltage wiring line 23, and the gate voltage of the TFT: M4 decreases toward the initialization voltage Vini. The initialization voltage Vini is set to the low level at which the TFT: M4 is turned on immediately after the voltage of the scanning line Gi changes to the low level (immediately after time t15).

Next, at time t13, the voltage of the initialization control line Di changes to the low level. Accordingly, the TFT: M7 is turned on. After time t13, the current passing through the TFT: M7 flows from the anode terminal of the organic EL element LI toward the initialization voltage wiring line 23, and the voltage of the anode terminal of the organic EL element L1 decreases toward the initialization voltage Vini.

Next, at time t14, the voltage of the initialization control line Di−1 changes to the high level. Accordingly, the TFT: M1 is turned off. The gate voltage of the TFT: M4 reaches the initialization voltage Vini before time t14. At time t14, the initialization of the gate terminal of the TFT: M4 ends.

Next, at time t15, the voltage of the scanning line Gi changes to the low level. Accordingly, the TFTs: M2, M3 are turned on. After time t15, since the gate terminal and the drain terminal of the TFT: M4 are electrically connected via the TFT: M2 in the ON state, the TFT: M4 is diode-connected. Hence the current passing through the TFTs: M3, M4, M2 flows from the data line Sj toward the gate terminal of the TFT: M4. This current increases the gate voltage of the TFT: M4. When the gate-source voltage of the TFT: M4 becomes equal to the threshold voltage of the TFT: M4, the current stops flowing. When the threshold voltage of the TFT: M4 is Vth (<0), and the data voltage applied to the data line Sj in the period from time t15 to time t16 is Vd, the gate voltage of the TFT: M4 after a sufficient time has elapsed from time t15 becomes (Vd−|Vth|).

Next, at time t16, the voltages of the initialization control line Di and the scanning line Gi change to the high level. Accordingly, the TFTs: M2, M3, M7 are turned off. The voltage of the anode terminal of the organic EL element L1 reaches the initialization voltage Vini before time t16. At time t16, the initialization of the anode terminal of the organic EL element LI ends. After time t16, the capacitor C1 holds the voltage between the electrodes (ELVDD−Vd+|Vth|).

Next, at time t17, the voltage of the light emission control line Ei changes to the low level. Accordingly, the TFTs: M5, M6 are turned on. After time t17, the current passing through the TFTs: M5, M4, M6 and the organic EL element LI flows from the first power supply wiring line 21 toward the second power supply wiring line 22. The gate-source voltage Vgs of the TFT: M4 is maintained at (ELVDD−Vd+|Vth|) by the action of the capacitor C1. Thus, a current Id flowing through the organic EL element L1 after time t17 is given by the following Formula (1) using a constant K.

$$Id = K(Vgs - |Vth|)^2 = k(ELVDD - Vd + |Vth| - |Vth|)^2 = K(ELVDD - Vd)^2 \quad (1)$$

As thus described, after time t17, the organic EL element L1 emits light with luminance corresponding to the data voltage Vd written to the pixel circuit 20 regardless of the threshold voltage Vth of the TFT: M4.

Hereinafter, a focus will be placed on the length of the time during which the voltage of the initialization control line Di−1 the low level in the non-light emission period when the voltage of the light emission control line Ei is at the high level. In FIG. 3, one period during which the voltage of the initialization control line Di−1 is at the low level is provided within the non-light emission period. Therefore, the length of the time during which the voltage of the initialization control line Di−1 is at the low level is equal to the length of the period during which the voltage of the initialization control line Di−1 is at the low level.

In FIG. 3, in the non-light emission period when the voltage of the light emission control line Ei is at the high level, the time during which the voltage of the initialization control line Di−1 is at the low level (the initialization period) is longer than the period during which the voltage of the scanning line Gi is at the low level (the write period). More specifically, in the non-light emission period, the length of the time during which the voltage of the initialization control line Di−1 is at the low level is twice or more the length of the write period. The write period is shorter than one horizontal period. At time t15 when the voltage of the scanning line Gi changes to the low level, a new data voltage is applied to the data line Sj. As thus described, the voltage of the scanning line Gi changes to the low level after the data voltage is applied to the data line Sj. At time t16 when the voltage of the scanning line Gi changes to the high level, a data voltage is applied to the data line Sj. As thus described, the voltage of the scanning line Gi changes to the high level before the application of the data voltage to the data line Sj ends.

During a period from time t13 to time t14, the voltages of the initialization control lines Di−1, Di are at the low level. Within the non-light emission period, one period during which the voltage of the initialization control line Di−1 is at the low level and one period during which the voltage of the initialization control line Di is at the low level are provided, and the two periods overlap partially. As thus described, within the non-light emission period, the period during which the voltage of the initialization control line Di−1 is at the low level and the period during which the voltage of the initialization control line Di is at the low level are provided one by one so as to partially overlap each other. At time t15, the voltage of the initialization control line Di and the voltage of the scanning line Gi change to the high level. As thus described, the voltage of the scanning line Gi changes to the high level when the voltage of the initialization control line Di changes to the high level. The voltage of the initialization control line Di−1 changes to the low level after the voltage of the light emission control line Ei changes to the high level, and the voltage of the initialization control line Di−1 changes to the high level before the voltage of the light emission control line Ei changes to the low level.

Figure 8:
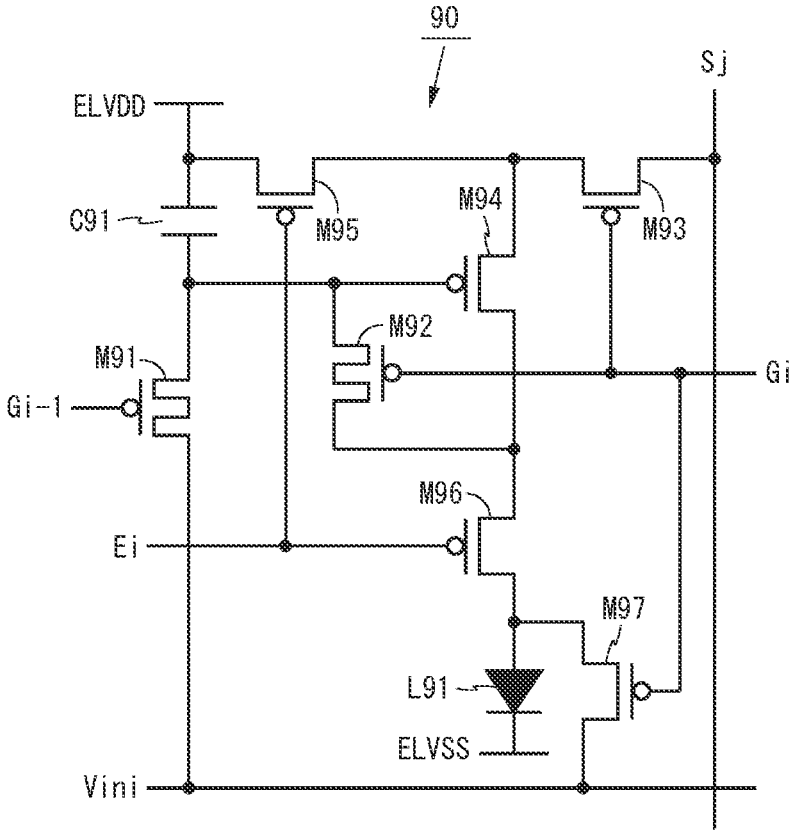
FIG. 8 Related Art
FIG. 8 is a circuit diagram of a pixel circuit of a known display device.
Figure 9:
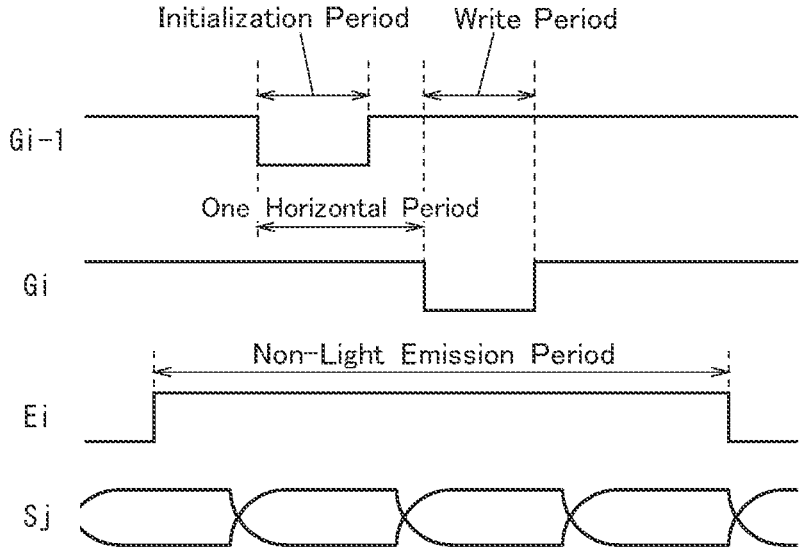
FIG. 9 Related Art
FIG. 9 is a timing chart of the known display device.

In the following, the effect of the display device 10 according to the present embodiment will be described in comparison with a display device (hereinafter referred to as a known display device) that includes the pixel circuit 90 illustrated in FIG. 8 and operates in accordance with the timing chart illustrated in FIG. 9. In the known display device, the gate terminals of the TFTs: M92, M93, M97 are connected to the scanning line Gi, and the gate terminal of the TFT: M91 is connected to the scanning line Gi−1. The gate terminal of the TFT: M94 is initialized in the initialization period during which the voltage of the scanning line Gi−1 is at the low level. In the known display device, the length of the period during which the voltage of the scanning line Gi−1 is at the low level is equal to the length of the period during which the voltage of the scanning line Gi is at the low level. Hence the initialization of the gate terminal of the TFT: M94 is performed for the same length of time as the writing of the data voltage. Therefore, in the known display device, the gate voltage of the TFT: M94 cannot be sufficiently initialized, and the image quality of a display image may deteriorate.

Figure 4:
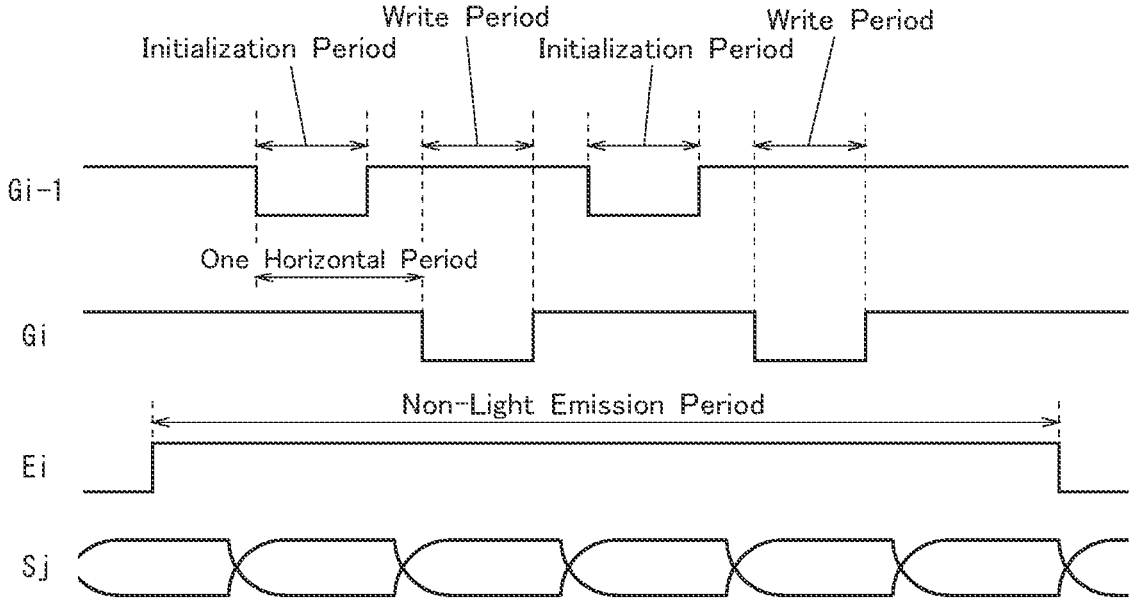
FIG. 4 Related Art
FIG. 4 is a timing chart of a display device according to a comparative example.

In order to solve this problem, a display device (hereinafter referred to as a display device according to a comparative example) that includes the pixel circuit 90 and operates in accordance with the timing chart illustrated in FIG. 4 is considered. In FIG. 4, within the non-light, emission period, two initialization periods during which the voltage of the scanning line Gi−1 is at the low level and two write periods during which the voltage of the scanning line Gi is at the low level are provided alternately. In the display device according to the comparative example, the initialization of the gate terminal of the TFT: M94 (drive transistor) and the writing of the data voltage are alternately performed twice. However, after the initialization voltage Vini is applied to the gate terminal of the TFT: M94 in the first initialization period, a voltage other than the initialization voltage Vini is applied to the gate terminal of the TFT: M94 in the first write period. Hence the effect of initializing the gate terminal of the TFT: M94 in the first initialization period is impaired in the first write period. Therefore, even in the display device according to the comparative example, the gate voltage of the TFT: M94 cannot be sufficiently initialized, and the image quality of a display image may deteriorate.

In contrast, in the display device 10 according to the present embodiment, the gate terminals of the TFTs: M2, M3 are connected to the scanning line Gi, and the gate terminal of the TFT: Ml is connected to the initialization control line Di−1. The gate terminal of the TFT: M4 is initialized in the initialization period during which the voltage of the initialization control line Di−1 is at the low level. The time during which the voltage of the initialization control line Di−1 is at the low level is longer than the write period during which the voltage of the scanning line Gi is at the low level. Thus, the initialization of the gate terminal of the TFT: M4 is performed for a longer time than the writing of the data voltage. It is thus possible to sufficiently initialize the gate terminal of TFT: M4 and perform high-quality display. In particular/even when the capacitance of the capacitor C1 connected to the gate terminal of the TFT: M4 is increased in order to perform high-luminance display, it is possible to sufficiently initialize the gate terminal of the TFT: M4 and perform high-luminance and high-quality display.

As described above, the display device 10 according to the present embodiment is provided with: the display portion 11 including the plurality of scanning lines G1 to Gm, the plurality of data lines S1 to Sn, the plurality of light emission control lines E1 to Em, the plurality of initialization control lines D0 to Dm, and the plurality of pixel circuits 20 arranged two-dimensionally; the scanning line drive circuit 13 that drives the scanning lines G1 to Gm; the data line drive circuit 14 that drives the data lines S1 to Sn; and the control line drive circuit 15 that drives the light emission control lines E1 to Em and the initialization control lines D0 to Dm. The plurality of initialization control lines D0 to Dm include a first initialization control line (initialization control line Di−1) and a second initialization control line (initialization control line Di) that extends in parallel to the scanning line Gi, corresponding to any one scanning line Gi of the plurality of scanning lines G1 to Gm. The pixel circuit 20 includes: an electro-optical element (organic EL element LI); a drive transistor (TFT: M4); a write control transistor (TFT: M3); a threshold compensation transistor (TFT: M2); a first light emission control transistor (TFT: M5); a second light emission control transistor (TFT: M6); a first initialization transistor (TFT: MI) having a first conduction terminal (source terminal) connected to the gate terminal of the drive transistor, a second conduction terminal (drain terminal) to which the initialization voltage Vini is applied, and a gate terminal connected to the first initialization control line; a second initialization transistor (TFT: M7) having a first conduction terminal connected to the first terminal (anode terminal) of the electro-optical element, a second conduction terminal to which the initialization voltage Vini is applied, and a gate terminal connected to the second initialization control line; and a capacitor C1 provided between the first conductive member and the gate terminal of the drive transistor. The second terminal (cathode terminal) of the electro-optical element is connected to the second conductive member.

In the non-light emission period when the voltage of the light emission control line EI is at the off-level (high level), the time during which the voltage of the first initialization control line is at the on-level (low level) is longer than the period during which the voltage of the scanning line Gi is at the on-level. In the non-light emission period, the length of the time during which the voltage of the first initialization control line is at the on-level is twice or more the length of the period during which the voltage of the scanning line Gi is at the on-level. The period during which the voltage of the scanning line Gi is at the on-level is shorter than one horizontal period. The voltage of the scanning lane Gi changes to the on-level after the data voltage corresponding to the video signal VS is applied to the data line Sj. The voltage of the scanning line Gi changes to the off-level before the application of the data voltage to the data line Sj ends. One period (period from time t12 to time t14) during which the voltage of the first initialization control line is at the on-level and one period (period from time t13 to time t16) during which the voltage of the second initialization control line is at the on-level partially overlap each other within the non-light emission period. The voltage of the scanning line Gi changes to the off-level at the timing when the voltage of the second initialization control line changes to the off-level. The voltage of the first initialization control line changes to the on-level after the voltage of the light emission control line Ei changes to the off-level, and changes to the off-level before the voltage of the light emission control line Ei changes to the on-level.

According to the display device 10 of the present embodiment, by making the time during which the voltage of the first initialization control line is at the on-level longer than the period during which the voltage of the scanning line Gi is at the on-level, the gate terminal of the drive transistor is initialized for a longer time than the writing of the data voltage. Hence, it is possible to sufficiently initialize the gate terminal of the drive transistor and perform high-quality display. In particular, even when the capacitance of the capacitor connected to the gate terminal of the drive transistor is increased in order to perform high-luminance display, it is possible to sufficiently initialize the gate terminal of the drive transistor and perform high-luminance and high-quality display. In addition, since the voltage of the scanning line Gi changes to the off-level at the timing when the voltage of the second initialization control line changes to the off-level, some clock signals can be shared between the scanning line drive circuit 13 and the drive circuits of the initialization control lines D0 to Dm.

Second Embodiment

A display device according to a second embodiment has the same configuration as the display device 10 according to the first embodiment and has the same pixel circuit 20 (cf. FIGS. 1 and 2). In the display device according to the present embodiment, the control line drive circuit 15 drives each of the initialization control lines D0 to Dm at timing different from that in the first embodiment. Hereinafter, the difference from the first embodiment will be described.

Figure 5:
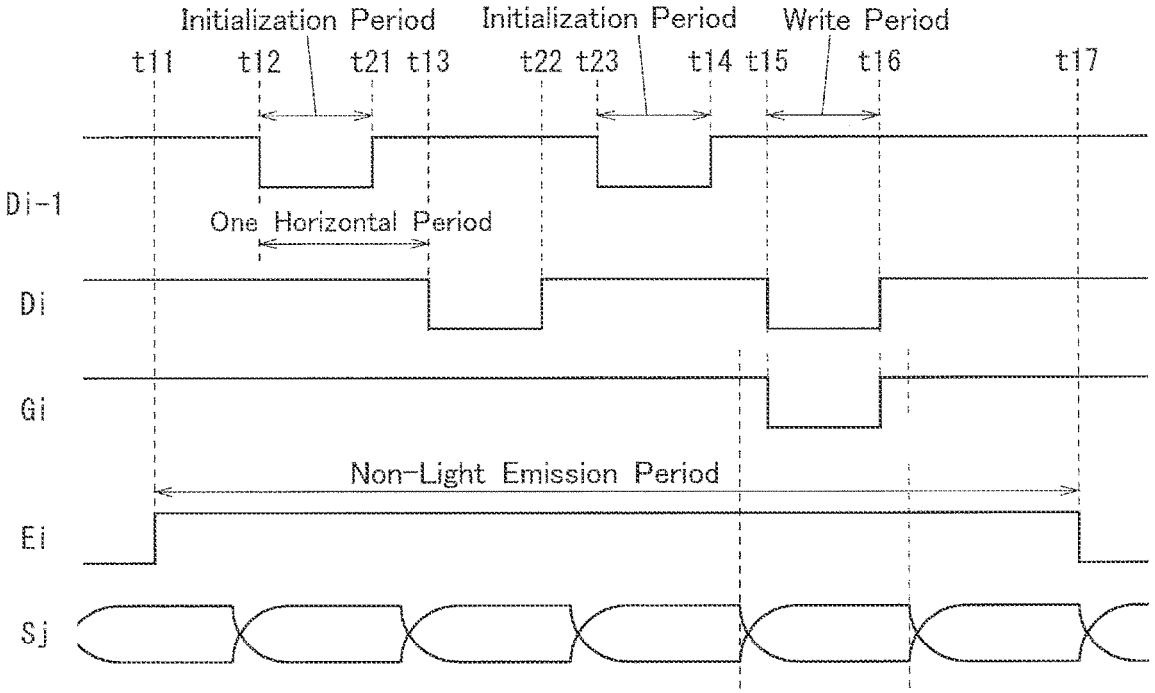
FIG. 5 is a timing chart of a display device according to a second embodiment.

FIG. 5 is a timing chart of the display device according to the present embodiment. FIG. 5 illustrates a change in voltage when a data voltage is written to the pixel circuit 20 in the ith row and the jth column. In the present embodiment, a period from time t12 to time t21 and a period from time t23 to time t14 are initialization periods of the pixel circuits 20 in the ith row.

Before time t11, the voltages of the initialization control lines Di−1, Di and the scanning line Gi are at a high level, and the voltage of the light emission control line Ei is at a low level. At time t11, the voltage of the light emission control line Ei changes to the high level. Next, at time t12, the voltage of the initialization control line Di−1 changes to the low level. The operation of the pixel circuit 20 before time t21 is the same as that in the first embodiment.

Next, at time t21, the voltage of the initialization control line Di−1 changes to the high level. Accordingly, the TFT: MI is turned off. After time t21, the current passing through the TFT: M1 stops, and the gate voltage of the TFT: M4 does not change. At time t21, the initialization of the gate terminal of the TFT: M4 is interrupted.

Next, at time t13, the voltage of the initialization control line Di changes to the low level. Accordingly, the TFT: M7 is turned on. After time t13, the current passing through the TFT: M7 flows from the anode terminal of the organic SL element L1 toward the initialization voltage wiring line 23, and the anode terminal of the organic EL element L1 decreases toward the initialization voltage Vini.

Next, at time t22, the voltage of the initialization control line Di changes to the high level. Accordingly, the TFT: M7 is turned off. After time t22, the current passing through the TFT: M7 stops, and the voltage of the anode terminal of the organic EL element L does not change. At time t22, the initialization of the anode terminal of the organic EL element L1 is interrupted.

Next, at time t23, the voltage of the initialization control line Di−1 changes to the low level. Accordingly, the TFT: M1 is turned on. After time t23, the current passing through the TFT: M1 flows again from the gate terminal of the TFT: M4 toward the initialization voltage wiring line 23, and the gate voltage of the TFT: M4 decreases again toward the initialization voltage Vini.

Next, at time t14, the voltage of the initialization control line Di−1 changes to the high level. Accordingly, the TFT: M1 is turned off. The gate voltage of the TFT: M4 reaches the initialization voltage Vini before time t14. At time t14, the initialization of the gate terminal of the TFT: M4 ends.

Next, at time t15, the voltage of the initialization control line Di changes to the low level. Accordingly, the TFT: M7 is turned on. After time t15, the current passing through the TFT: M7 flows again from the anode terminal of the organic EL element L1 toward the initialization voltage wiring line 23, and the voltage of the anode terminal of the organic EL element L1 decreases again toward the initialization voltage Vini.

At time t15, the voltage of the scanning line Gi changes to the low level. Next, at time t16, the voltages of the initialization control line Di and the scanning line Gi change to the high level. Next, at time t17, the voltage of the light emission control line Ei changes to the low level. The operation of the pixel circuit 20 after time t15 is the same as that in the first embodiment.

In FIG. 5, two periods during which the voltage of the initialization control line Di−1 is at the low level are provided within the non-light emission period. Therefore, the length of the time during which the voltage of the initialization control line Di−1 is at the low level is equal to the sum of the lengths of the two periods during which the voltage of the initialization control line Di−1 is at the low level. In the present embodiment, similarly to the first embodiment, in the non-light emission period, the time during which the voltage of the initialization control line Di−1 is at the low level (the sum of the lengths of the two initialization periods) is longer than the period (write period) during which the voltage of the scanning line Gi is at the low level. In the non-light emission period, the length of the time during which the voltage of the initialization control line Di−1 is at the low level is twice the length of the write period.

In FIG. 5, within the non-light emission period, two periods during which the voltage of the initialization control line Di−1 is at the low level and two periods during which the voltage of the initialization control line Di is at the low level are provided alternately. The period during which the voltage of the initialization control line Di−1 is at the low level and the period during which the voltage of the initialization control line Di is at the low level do not overlap. The voltage of the scanning line Gi changes to the high level at the timing when the voltage of the initialization control line Di changes to the high level last within the non-light emission period, and changes to the low level at the timing when the voltage of the initialization control line Di changes to the low level last within the non-light emission period.

As described above, in the display device according to the present embodiment, within the non-light emission period when the voltage of the light emission control line Ei is at the off-level (high level), a plurality of (two) periods during which the voltage of the first initialization control line (initialization control line Di−1) is at the on-level (low level) and a plurality of (two) periods during which the voltage of the second initialization control line (initialization control line Di) is at the on-level are provided. The period during which the voltage of the first initialization control line is at the on-level and the period during which the voltage of the second initialization control line is at the on-level do not overlap. Within the non-light emission period, the period during which the voltage of the first initialization control line is at the on-level and the period during which the voltage of the second initialization control line is at the on-level are provided alternately. The voltage of the scanning line Gi changes to the off-level at the timing when the voltage of the second initialization control line changes to the off-level last within the non-light emission period, and changes to the on-level at the timing when the voltage of the second initialization control line changes to the on-level last within the non-light emission period.

In the display device according to the present embodiment, similarly to the display device according to the first embodiment, by making the time during which the voltage of the first initialization control line is at the on-level longer than the period during which the voltage of the scanning line Gi is at the on-level, it is possible to sufficiently initialize the gate terminal of the drive transistor (TFT: M4) and perform high-quality display. In addition, since the voltage of the scanning line Gi changes to the off-level at the timing when the voltage of the second initialization control line changes to the off-level last within the non-light emission period, and changes to the on-level at the timing when the voltage of the second initialization control line changes to the on-level last within the non-light emission period, the same circuit (shift register) can be used for the scanning line drive circuit 13 and the drive circuits of the initialization control lines D0 to Dm.

Third Embodiment

A display device according to a third embodiment has the same configuration as the display device 10 according to the first embodiment and has the same pixel circuit 20 (cf. FIGS. 1 and 2). In the display device according to the present embodiment, the control line drive circuit 15 drives each of the initialization control lines D0 to Dm at timing different from that in the first and second embodiments. Hereinafter, the difference from the first and second embodiments will be described.

Figure 6:
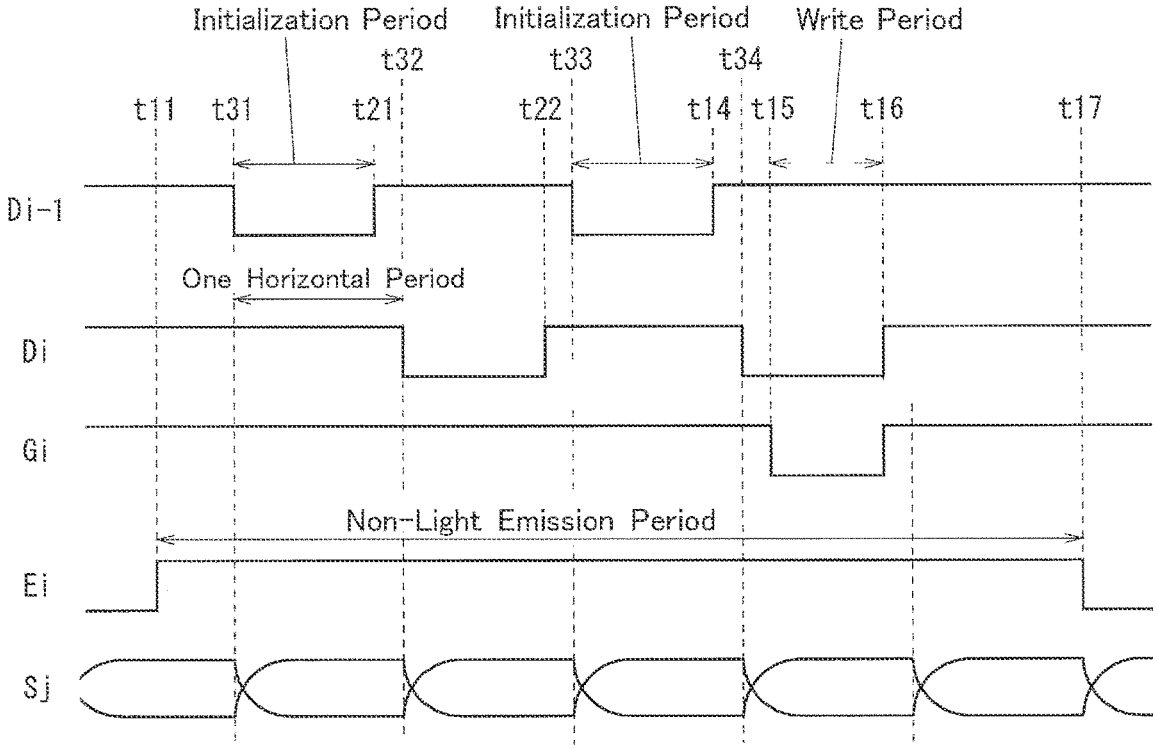
FIG. 6 is a timing chart of a display device according to a third embodiment.

FIG. 6 is a timing chart of the display device according to the present embodiment. FIG. 6 illustrates a change in voltage when a data voltage is written to the pixel circuit 20 in the ith row and the jth column. In the timing chart illustrated in FIG. 6, the timing at which each of the voltages of the initialization control lines Di−1, Di change to the low level is earlier than in the timing chart illustrated in FIG. 5.

In the timing chart illustrated in FIG. 5, the voltage of the initialization control line Di−1 changes to the low level at time t12 and time t23, and the voltage of the initialization control line Di changes to the low level at time t13 and time t15. At each of times t12, t13, t23, t15, a new data voltage is applied to the data line Sj. In contrast, in the timing chart illustrated in FIG. 6, the voltage of the initialization control line Di−1 changes to the low level at time t31 and time t33, and the voltage of the initialization control line Di changes to the low level at time t32 and time t34. Each of times t31, t32, t33, t34 is a time when a new voltage starts to be applied to the data line Sj. Times t31, t32, t33, t34 are earlier than times t12, t13, t23, t15, respectively.

In FIG. 6, the voltage of the scanning line Gi changes to the low level after the voltage of the initialization control line Di changes to the low level last within the non-light emission period. The last period of the plurality of periods during which the voltage of the initialization control line Di provided in the non-light emission period is at the low level is longer than the period during which the voltage of the scanning line Gi is at the low level.

As described above, in the display device according to the present embodiment, the voltage of the scanning line Gi changes to the on-level after the voltage of the second initialization control line (initialization control line Di) changes to the on-level (low level) last within the non-light emission period. The last period of the plurality of periods during which the voltage of the second initialization control line provided in the non-light emission period is at the on-level is longer than the period during which the voltage of the scanning line Gi is at the on-level.

In the display device according to the present embodiment, similarly to the display devices according to the first and second embodiments, by making the time during which the voltage of the first initialization control line is at the on-level longer than the period during which the voltage of the scanning line Gi is at the on-level, it is possible to sufficiently initialize the gate terminal of the drive transistor (TFT: M4) and perform high-quality display. In addition, since the voltage of the scanning line Gi changes to the on-level after the voltage of the second initialization control line changes to the on-level last within the non-light emission period, it is possible to lengthen the time during which the voltage of the first initialization control line is at the on-level while delaying the timing at which the voltage of the scanning line Gi changes to the on-level in consideration that the signal waveforms on the data lines S1 to Sn are blunted.

Figure 7:
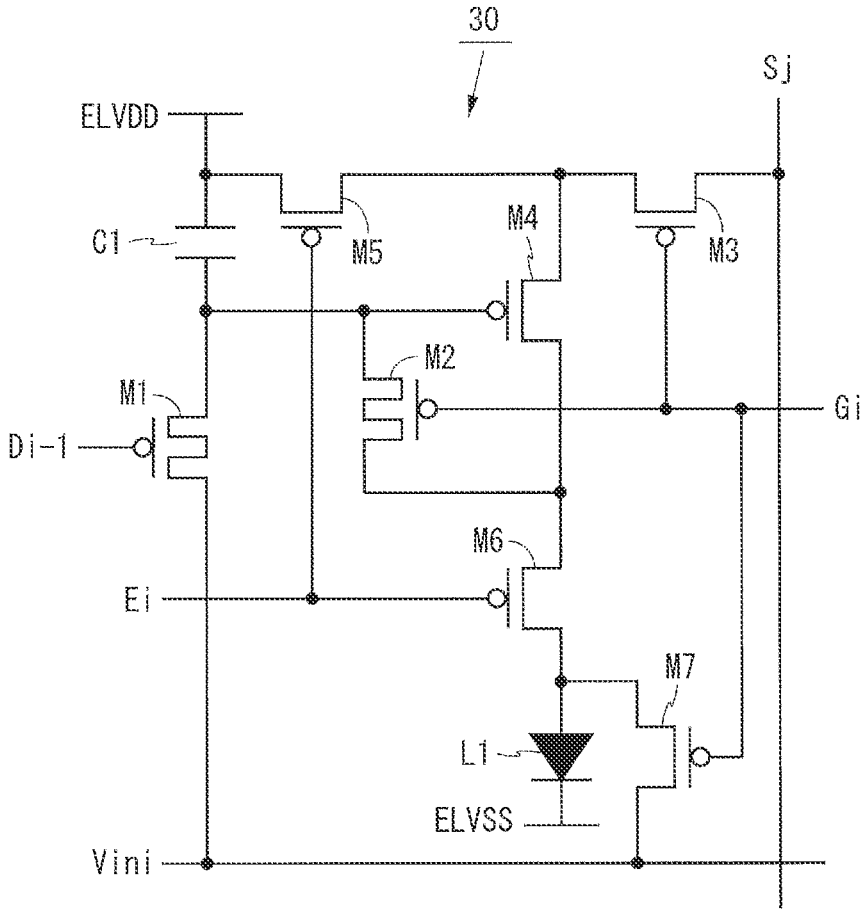
FIG. 7 is a circuit diagram of a pixel circuit of a display device according to a modification example.

For the display devices according to the first to third embodiments, the following modification examples can be configured. FIG. 7 is a circuit diagram of a pixel circuit of a display device according to a modification example. In the pixel circuit 20 of each of the display devices according to the first to third embodiments, the gate terminal of the TFT: M7 is connected to the initialization control line Di. In the pixel circuit 30 of the display device according to the modification example, the gate terminal of the TFT: M7 is connected to the scanning line Gi. Even in the display device including the pixel circuit 30 instead of the pixel circuit 20, the same effects as those of the display devices according to the first to third embodiments can be obtained. The display device according to the modification example may include a pixel circuit in which the TFT: M7 is deleted from the pixel circuit 20.

In the pixel circuit 20 of the display device according to the first to third embodiments, the drain terminal of the TFT: M6 (the second conduction terminal of the second light emission control transistor) is connected to the anode terminal of the organic EL element L1 and the cathode terminal of the organic EL element L1 is connected to the second power supply wiring line 22 (second conductive member). In a pixel circuit of a display device according to a modification example, the second conduction terminal of the second light emission control transistor may be connected to the cathode terminal of the organic EL element, and the anode terminal of the organic EL element may be connected to the second conductive member.

In the non-light emission period when the voltage of the light emission control line Ei is at the off-level, a display device according to a modification example may operate in accordance with a timing chart except for the above, the timing chart satisfying the condition that the time during which the voltage of the first initialization control line (initialization control line Di−1) is at the on-level is longer than the period during which the voltage of the scanning line Gi is at the on-level. For example, in the timing chart illustrated in FIG. 3, the initialization control line Di−1 may change to the low level before time t12, and the initialization control line Di may change to the low level before time t13. Further, in the timing charts illustrated in FIGS. 5 and 6, three or more initialization periods during which the initialization control line Di−1 is at the low level and three or more periods during which the initialization control line Di is at the low level may be provided within the non-light emission period.

Although the organic EL display device provided with the pixel circuit including the organic EL element (organic light-emitting diode) has been described as an example of the display device provided with the pixel circuit including the electro-optical element, an inorganic EL display device provided with a pixel circuit including an inorganic light-emitting diode or a quantum-dot light-emitting diode (QLED) display device provided with a pixel circuit including a quantum dot light-emitting diode may be configured by a similar method.

DESCRIPTION OF REFERENCE CHARACTERS

10: DISPLAY DEVICE
11: DISPLAY PORTION
12: DISPLAY CONTROL CIRCUIT
13: SCANNING LINE DRIVE CIRCUIT
14: DATA LINE DRIVE CIRCUIT
15: CONTROL LINE DRIVE CIRCUIT
20, 30: PIXEL CIRCUIT
21: FIRST POWER SUPPLY WIRING LINE
22: SECOND POWER SUPPLY WIRING LINE
23: INITIALIZATION VOLTAGE WIRING LINE

The invention claimed is:

1. A display device comprising:

a display portion including a plurality of scanning lines, a plurality of data lines, a plurality of light emission control lines, a plurality of initialization control lines, and a plurality of pixel circuits arranged two-dimensionally;

a scanning line drive circuit configured to drive each of the plurality of scanning lines;

a data line drive circuit configured to drive each of the plurality of data lines;

a light emission control line drive circuit configured to drive each of the plurality of light emission control lines; and an initialization control line drive circuit configured to drive each of the plurality of initialization control lines, wherein the plurality of initialization control lines includes, for each scanning line, a first initialization control line that corresponds to the each scanning line and extends in parallel with the each scanning line, and a second initialization control line that corresponds to the each scanning line, extends in parallel with the each scanning line, and is selected one horizontal period later than the first initialization control line, each pixel circuit corresponds to one of the plurality of scanning lines, corresponds to one of the plurality of data lines, and corresponds to one of the plurality of light emission control lines, each pixel circuit includes an electro-optical element provided on a path connecting first and second conductive members that each supply a power supply voltage, the electro-optical element being configured to emit light with luminance corresponding to a current flowing through the path, a drive transistor provided on the path in series with the electro-optical element and configured to control an amount of current flowing through the path, a write control transistor having a first conduction terminal connected to a corresponding data line of the plurality of data lines, a second conduction terminal connected to a first conduction terminal of the drive transistor, and a gate terminal connected to a corresponding scanning line of the plurality of scanning lines, a threshold compensation transistor having a first conduction terminal connected to a second conduction terminal of the drive transistor, a second conduction terminal connected to a gate terminal of the drive transistor, and a gate terminal connected to the corresponding scanning line, a first light emission control transistor having a first conduction terminal connected to the first conductive member, a second conduction terminal connected to the first conduction terminal of the drive transistor, and a gate terminal connected to a corresponding light emission control line of the plurality of light emission control lines, a second light emission control transistor having a first conduction terminal connected to the second conduction terminal of the drive transistor, a second conduction terminal connected to a first terminal of the electro-optical element, and a gate terminal connected to the corresponding light emission control line, a first initialization transistor having a first conduction terminal connected to the gate terminal of the drive transistor, a second conduction terminal to which an initialization voltage is applied, and a gate terminal connected to a corresponding first initialization control line, the corresponding first initialization control line being a first initialization control line corresponding to the corresponding scanning line, a second initialization transistor having a first conduction terminal connected to the first terminal of the electro-optical element, a second conduction terminal to which the initialization voltage is applied, and a gate terminal connected to a corresponding second initialization control line, the corresponding second initialization control line being a second initialization control line corresponding to the corresponding scanning line, and a capacitor provided between the first conductive member and the gate terminal of the drive transistor, a second terminal of the electro-optical element is connected to the second conductive member, and in a non-light emission period when a voltage of the corresponding light emission control line is at an off-level, time during which a voltage of the corresponding first initialization control line is at an on-level is longer than a period during which a voltage of the corresponding scanning line is at the on-level.

2. The display device according to claim 1, wherein within the non-light emission period, the length of the time during which the voltage of the corresponding first initialization control line is at the on-level is twice or more than the length of the period during which the voltage of the corresponding scanning line is at the on-level.

3. The display device according to claim 1, wherein the period during which the voltage of the corresponding scanning line is at the on-level is shorter than one horizontal period.

4. The display device according to claim 1, wherein the voltage of the corresponding scanning line changes to the on-level after a data voltage corresponding to a video signal is applied to the corresponding data line.

5. The display device according to claim 4, wherein the voltage of the corresponding scanning line changes to the off-level before the application of the data voltage to the corresponding data line ends.

6. The display device according to claim 1, wherein the period during which the voltage of the corresponding first initialization control line is at the on-level and a period during which a voltage of the corresponding second initialization control line is at the on-level are provided one by one so as to partially overlap each other within the non-light emission period.

7. The display device according to claim 1, wherein the voltage of the corresponding scanning line changes to the off-level at timing when the voltage of the corresponding second initialization control line changes to the off-level.

8. The display device according to claim 1, wherein a plurality of periods during which the voltage of the corresponding first initialization control line is at the on-level and a plurality of periods during which a voltage of the corresponding second initialization control line is at the on-level are provided within the non-light emission period.

9. The display device according to claim 8, wherein each of the periods during which the voltage of the corresponding first initialization control line is at the on-level and each of the periods during which the voltage of the corresponding second initialization control line is at the on-level do not overlap.

10. The display device according to claim 8, wherein the period during which the voltage of the corresponding first initialization control line is at the on-level and the period during which the voltage of the corresponding second initialization control line is at the on-level are alternately provided within the non-light emission period.

11. The display device according to claim 8, wherein the voltage of the scanning line changes to the off-level at timing when the voltage of the corresponding second initialization control line changes to the off-level last within the non-light emission period.

12. The display device according to claim 8, wherein the voltage of the corresponding scanning line changes to the on-level at timing when the voltage of the corresponding second initialization control line changes to the on-level last within the non-light emission period.

13. The display device according to claim 8, wherein the voltage of the corresponding scanning line changes to the on-level after the voltage of the corresponding second initialization control line changes to the on-level last within the non-light emission period.

14. The display device according to claim 8, wherein a last period of the plurality of periods during which the voltage of the corresponding second initialization control line provided within the non-light emission period is at the on-level is longer than a period during which the voltage of the corresponding scanning line is at the on-level.

15. The display device according to claim 1, wherein the voltage of the corresponding first initialization control line changes to the on-level after the voltage of the corresponding light emission control line changes to the off-level.

16. The display device according to claim 1, wherein the voltage of the corresponding first initialization control line changes to the off-level before the voltage of the corresponding light emission control line changes to the on-level.

17. A method for driving a display device provided with a display portion including a plurality of scanning lines, a plurality of data lines, a plurality of light emission control lines, a plurality of initialization control lines, and a plurality of pixel circuits arranged two-dimensionally, wherein the plurality of initialization control lines includes, for each scanning line, a first initialization control line that corresponds to the each scanning line and extends in parallel with the each scanning line, and a second initialization control line that corresponds to the each scanning line, extends in parallel with the each scanning line, and is selected one horizontal period later than the first initialization control line, each pixel circuit corresponds to one of the plurality of scanning lines, corresponds to one of the plurality of data lines, and corresponds to one of the plurality of light emission control lines, each pixel circuit includes an electro-optical element provided on a path connecting first and second conductive members that each supply a power supply voltage, the electro-optical element being configured to emit light with luminance corresponding to a current flowing through the path, a drive transistor provided on the path in series with the electro-optical element and configured to control an amount of current flowing through the path, a write control transistor having a first conduction terminal connected to a corresponding data line of the plurality of data lines, a second conduction terminal connected to a first conduction terminal of the drive transistor, and a gate terminal connected to a corresponding scanning line of the plurality of scanning lines, a threshold compensation transistor having a first conduction terminal connected to a second conduction terminal of the drive transistor, a second conduction terminal connected to a gate terminal of the drive transistor, and a gate terminal connected to the corresponding scanning line, a first light emission control transistor having a first conduction terminal connected to the first conductive member, a second conduction terminal connected to the first conduction terminal of the drive transistor, and a gate terminal connected to a corresponding light emission control line of the plurality of light emission control lines, a second light emission control transistor having a first conduction terminal connected to the second conduction terminal of the drive transistor, a second conduction terminal connected to a first terminal of the electro-optical element, and a gate terminal connected to the corresponding light emission control line, a first initialization transistor having a first conduction terminal connected to the gate terminal of the drive transistor, a second conduction terminal to which an initialization voltage is applied, and a gate terminal connected to a corresponding first initialization control line, the corresponding first initialization control line being a first initialization control line corresponding to the corresponding scanning line, a second initialization transistor having a first conduction terminal connected to the first terminal of the electro-optical element, a second conduction terminal to which the initialization voltage is applied, and a gate terminal connected to a corresponding second initialization control line, the corresponding second initialization control line being a second initialization control line corresponding to the corresponding scanning line, and a capacitor provided between the first conductive member and the gate terminal of the drive transistor, a second terminal of the electro-optical element is connected to the second conductive member, the method comprises:

controlling a voltage of the corresponding light emission control line to an off-level to control the electro-optical element to a non-light emitting state;

controlling a voltage of the corresponding first initialization control line to an on-level to initialize the gate terminal of the drive transistor;

controlling a voltage of the corresponding second initialization control line to an on-level to initialization the first terminal of the electro-optical element and driving the corresponding scanning line and the corresponding data line to write a data voltage corresponding to a video signal to the gate terminal of the drive transistor, and in a non-light emission period when the voltage of the corresponding light emission control line is at the off-level, time during which the voltage of the corresponding first initialization control line is at the on-level is longer than a period during which a voltage of the corresponding scanning line is at the on-level.

* * * * *